United States Patent [19]

Kibby

[11] 4,033,757

[45] July 5, 1977

[54] CARBOTHERMIC REDUCTION PROCESS

[75] Inventor: Robert Milton Kibby, Richmond, Va.

[73] Assignee: Reynolds Metals Company, Richmond, Va.

[22] Filed: Sept. 5, 1975

[21] Appl. No.: 610,684

[52] U.S. Cl. ..... 75/10 R; 75/68 A

[51] Int. Cl.[2] ..... C22B 21/02

[58] Field of Search ..... 75/10 R, 68 R, 68 A

[56] References Cited

UNITED STATES PATENTS

| | | | |
|---|---|---|---|
| 3,723,093 | 3/1973 | Shiba et al. | 75/10 R |
| 3,929,456 | 12/1975 | Kibby | 75/10 R |

*Primary Examiner*—M. J. Andrews

*Attorney, Agent, or Firm*—Glenn, Lyne, Gibbs & Clark

[57] ABSTRACT

A carbothermic process for the production of aluminum contaminated with no more than about 10 weight percent of aluminum carbide is disclosed which involves charging alumina values and carbon values into a furnace and subjecting only a minor portion of said charge at any given time of an open arc so as to heat the reagents to reaction temperture. The various vapors which form pass through the charge where they undergo additional reaction. The aluminum formed flows over the charge which is maintained at a temperature lower than reaction temperature, so as to obtain aluminum contaminated with no more than about 10 weight percent of aluminum carbide.

4 Claims, 2 Drawing Figures

CARBOTHERMIC REDUCTION PROCESS

BACKGROUND OF INVENTION

This invention relates to the carbothermic production of aluminum from aluminum oxide and a carbonaceous material, such as carbon, wherein said alumina and carbon are charged to a reduction furnace operated under very specific conditions so as to result in the production of aluminum contaminated with no more than about 10 weight percent of aluminum carbide.

DESCRIPTION OF THE PRIOR ART

There has been much time and attention devoted by the workers in the prior art in an attempt to produce aluminum by a carbothermic process as opposed to the electrolytic process. The potential advantages in the use of a carbothermic process for the production of aluminum have been known for some time and they have even assumed greater importance in recent times due to the high energy costs which have been brought about at least in part by the increased cost of fossil fuels. In spite of all the potential advantages of a carbothermic process over an electrolytic process, the simple fact remains that the latter processes account for substantially all the aluminum produced in the world today.

There have been many theories advanced by many authors as to why it is not possible to produce substantially pure aluminum from a carbothermic process. In recent years there have been patents issued such as U.S. Pat. No. 3,723,093 which proport to disclose process for the production of aluminum produced will of substantial purity via a carbothermic process. In addition, U.S. Pat. No. 3,607,221 also discloses a process for the carbothermic production of substantially pure aluminum utilizing very high temperatures.

In copending application Ser. No. 407,271, filed Oct. 17, 1973, now U.S. Pat. No. 3,929,456 there is disclosed and claimed a carbothermic process for the production of substantially pure aluminum utilizing aluminum oxide and a carbonaceous reductant and heating the charge in such a manner such that the aluminum formed by the reaction of the charge is maintained substantially in the liquid state.

The majority of processes for the carbothermic production of aluminum always result in the production of aluminum contaminated with aluminum carbide and, in fact, for reasons which are not completely understood the aluminum carbide contamination is always in the range of approximately 20 weight percent or higher. There is a very severe practical difficulty which arises in attempting to further purify aluminum which is contaminated with aluminum carbide in significant amounts due to the fact that the mixture becomes nonpourable unless extremely high temperatures are maintained, such that the problem of purifying the mass becomes extremely complex. Thus, although the art is replete with various techniques for the removal of aluminum carbide from a mixture of the same with aluminum, the simple fact remains that such processes cannot achieve their maximum potential unless a very practical and readily available source of aluminum contaminated with no more than about 10 weight percent of aluminum carbide can be achieved. It should be noted that the amount of aluminum carbide contamination bears a direct relationship to the temperature which is employed, i.e., at the normal reduction temperatures employed in a furnace the amount of aluminum carbide which can dissolve in the formed aluminum is about 20 weight percent or higher. It is not too surprising that the majority of prior art processes resulted in the production of high aluminum carbide containing products for the simple reason that they utilized uniform heating such that the majority of the charge was at a uniformly high temperature and, therefor, it was possible to dissolve aluminum carbide in appreciable amounts.

SUMMARY OF THE INVENTION

The furnace operation is carried out such that an intermittent type of heating is applied to the charge to be reduced such that a portion of the charge is at reaction temperature (about 2100° C) but the majority of the charge is not at reaction temperature at any given time. In aforementioned copending application Ser. No. 407,271 filed Oct. 17, 1973, now U.S. Pat. No. 3,929,456 there is described various procedures for applying intermittent heat to a furnace charge, but said copending application requires the maintaining of the aluminum formed by the charge substantially in the liquid state. In the instant process, no such restraint is necessary and, in fact, provision is made for the various vapors which are formed to pass through the unreacted charge and to further react to produce aluminum, thereby recovering the energy that was expended in the vaporization reactions.

It is extremely important in carrying out the novel process of this invention that the majority of the charge never reaches reaction temperature at any given time, such that when the formed aluminum flows over the charge, the charge is never at a temperature where it is possible to dissolve more than about 10 weight percent of aluminum carbide.

DESCRIPTION OF THE DRAWING FIGURES

Figure 1:
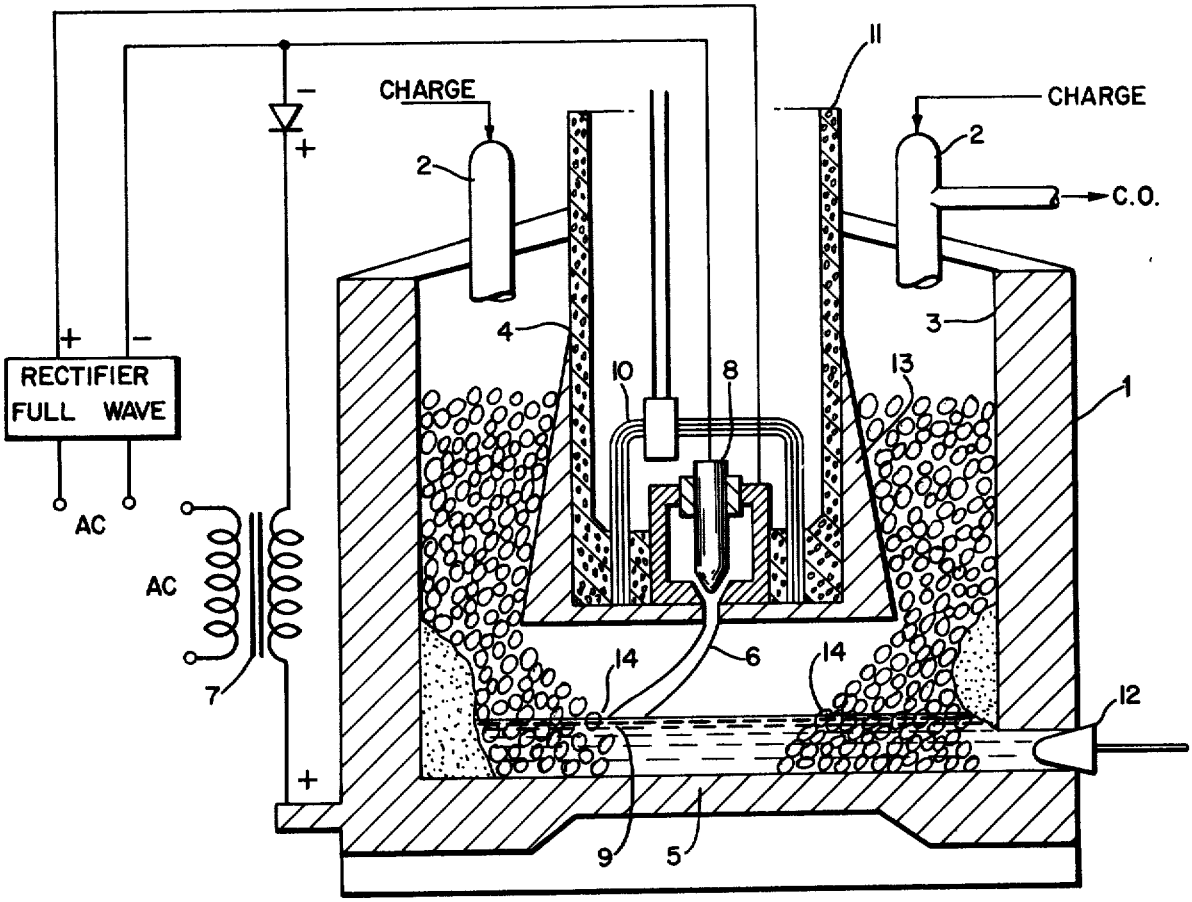
FIG. 1 is a cross-sectional elevation of a furnace suitable for carrying out the instant process.

FIG. 1 represents a furnace suitable for carrying out the instant process. The charge comprising a prereduction product containing $Al_4O_4C$ plus additional carbon is introduced into furnace 1 through charging port 2 so as to be placed in the annular space formed between the side wall 3 of the furnace 1 and the electrode casing 4 and deflector 13. The charge rests upon a carbon hearth 5 and mixed with a pool of aluminum containing about 10 weight percent $Al_4c_3$ maintained at about 1850°–1950° C. In this drawing the heat source is a plasma jet 6 connected to a secondary power supply 7 to transfer its arc from negative electrode 8 to the molten pool 9. The arc column is deflected by two or more sets of magnetic circuits 10 which are phased to rotate the arc at the desired frequency, for example, one cycle per second. Insulation 11 protects the electrode from damage and the product is removed via port 12.

As illustrated in FIG. 1, a deflector 13 is provided to prevent the charge from flowing and filling under the heat source. The dimension of the bottom wall of deflector 13 is such that the angle of repose of the charge determines the location 14 where the charge intersects the molten pool. The diameter of this circle of intersection is preferably equal to the diameter of the circle formed by the arc as it migrates under the influence of the magnetic field. In this manner, an open arc is assured.

It will be appreciated that direct conduction of electricity from any part of the electrode or plasma torch to the charge is detrimental for at least two reasons. Firstly, under such resistive heating, it is difficult to assure that the temperature of the background charge and product pool are maintained below 1950° C when the reacting surface is taken to the reaction temperature of about 2100°–2300° C. It is the intermittent application of an open arc which permits the desired dual temperature condition required for the production of aluminum containing less than 10% $Al_4C_3$. Secondly, charge materials which are allowed to conduct to the electrode assembly, tend to stick to the assembly and interfere with the electrical performance of the electrode system.

Figure 2:
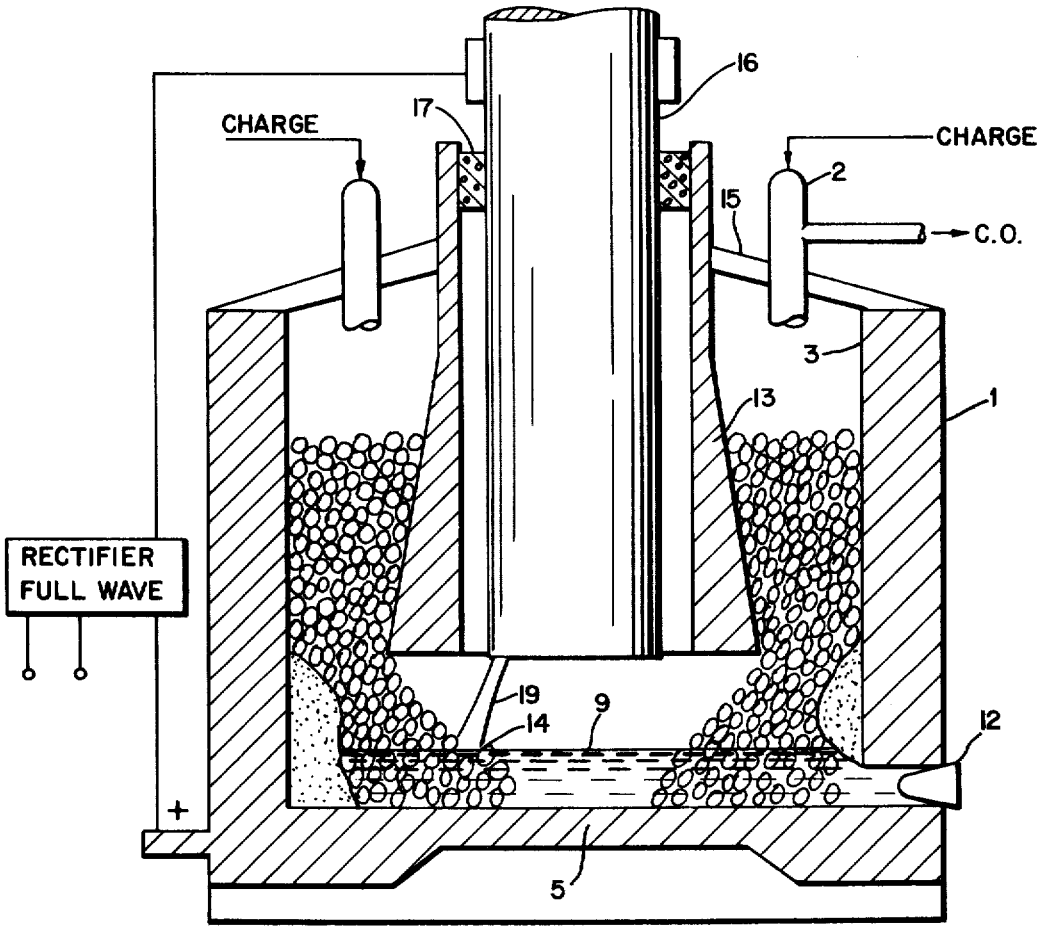
FIG. 2 is a cross-sectional elevation of a furnace having a carbon electrode suitable for carrying out the instant process.

FIG. 2 represents a furnace suitable for carrying out the instant process, wherein a carbon electrode is used as a source of intermittently applied heat. The charge is introduced into furnace 1 through charge port 2 so as to be placed in the annular space formed between the sidewall 3 of the furnace and an electrode shield casing 13. The sidewalls and electrode shield casing may be of carbon. The electrode shield casing is supported from the furnace roof 15 and is electrically insulated from the electrode 16 by means of sliding seal 17. The charge rests upon a carbon hearth 5 and mixes with a pool of aluminum containing about 10 weight percent $Al_4C_3$ maintained at about 1850°–1950° C. In this drawing the heat source is the arc 19 emitted from electrode 16 and striking the intersection 14 between the charge and the molten pool 9. The power source is a full wave rectifier connected to make the electrode 16 negative and the hearth 5 positive. The arc column 19 must be smaller in diameter than the electrode 16 in order to be stable. Depending on the heat balance of an arc column and the vapor pressure of aluminum in the area of the arc, each stable arc must carry currents sufficiently high that one or more arcs migrate over the surface of the electrode, tending to stay confined to the peripheral corner of the electrode. Such arcs strike the charge to be reduced and the adjacent metal intermittently, but randomly. The electrode shield 13 prevents the charge from filling in under and making electrical contact with the electrode, which assures an open arc. Vapor products from the heating of charge and product pool by arc 19 are passed through the charge column between wall 3 and shield 13 where they react to produce liquid aluminum and/or products which yield aluminum by the heating action of the arc. The major portion of the charge in the arc heating reaction zone and the vapor reaction zone is held at 1850° C or less. The aluminum product containing 10% or less $Al_4C_3$ is removed via port 12.

DESCRIPTION OF THE PREFERRED EMBODIMENTS

The novel process of this invention advantageously employs a prereduction step in which alumina is reacted with a carbonaceous material in order to form an intermediate product containing $Al_4O_4C$. In carrying out the prereduction step, alumina and coke or coal char are blended and preferably shaped into briquettes in the proportions of two moles of alumina for three moles of carbon and the mixture is thereafter heated to a temperature of about 1900°–1950° C and more preferably at about 1920° C. The briquettes are preferably converted to said $Al_4O_4C$ in a shaft furnace which may be heated electrically or by the combustion of additional carbon with oxygen. The $Al_4O_4C$ which is obtained by prereduction in a separate furnace is thereafter mixed with additional coke or coal char at a rate to yield a composite charge having a carbon to oxygen mole ratio of about 1:1. Thus, for example, each mole of $Al_4O_4C$ in briquette form is mixed with three moles of carbon.

It is preferred that the charge to the reduction furnace of FIG. 1 be a mixture of carbon and briquettes containing $Al_4O_4C$. The briquettes should be formulated by mixing an aluminum oxide and a carbon rich compound to yield, upon complete reaction, the compound $Al_4O_4C$.

Complete reaction to form $Al_4O_4C$ in the briquette is desirable because this represents a significant degree of reduction which can be performed ahead of the furnace of FIG. 1, thereby relieving the intermittent open arc furnace of all but the most critical reduction steps.

Although desirable, it is not necessary that this reaction to form $Al_4O_4C$ be 100% complete before the briquettes are added to the reduction furnace.

It is important, however, to have some $Al_4O_4C$ in the briquettes by the time the briquettes reach the reaction zone, because the $Al_4O_4C$ melts and provides a liquid surface in contact with the carbon needed to reduce it to aluminum, thus improving the reaction rates and ability of the reaction zone to receive high heat fluxes without excessive vaporization.

The charge mixture is then fed into the annular space formed between the side wall of the furnace and the electrode casing, as is set forth in FIG. 1, and an arc is applied to the charge as illustrated in FIG. 1 in such a manner that the arc strikes the metal pool at the intersection of the charge burden with the pool. The majority of the charged burden not struck by the arc is maintained at a temperature between 1650° C and 1850° C.

Typical of the reactions occurring in the furnace are the following:

1. $Al_4O_4C + 3C \rightarrow 4\ Al\ (l) + 4\ CO$
2. $Al_4O_4C + 3C \rightarrow 4\ Al\ (g) + 4\ CO$
3. $Al_4O_4C + 3C \rightarrow 2\ Al_2O\ (g) + 2\ CO + 2\ C$
4. $Al\ (g) + 3C \rightarrow Al_4C_3$
5. $2\ Al_2O\ (g) + 2CO \rightarrow Al_4O_4C + C$
6. $Al_4O_4C + Al_4C_3 \rightarrow 8\ Al\ (l) + 4\ CO$
7. $2\ Al\ (g) + CO \rightarrow Al_2OC$
8. $Al\ (g) \rightarrow Al\ (l)$ The surface of the charge being struck by the arc heats up until a surface temperature of about 2100° C is achieved. As the reactions 1, 2, and 3 proceed, heat is absorbed, tending to stabilize the surface temperature at about 2100° C.

Only when the heat flux exceeds the heat absorbed by the reaction does the temperature exceed 2100° C, causing high vaporization rates. With the surfaces stabilized at about 2100° C, about 20% of the aluminum is vaporized with the vapor composition being about 50 mol % aluminum and 50 mol % $Al_2O$.

The aluminum vapor reacts with carbon in the charge to form $Al_4C_3$ according to reaction 4. Some of the aluminum condenses directly on surfaces of charge at 2100° C as taught in U.S. Pat. No. 3,607,221. Aluminum can also react with CO to form $Al_2OC$ at temperatures below 2100° C as in reaction 7.

As the $Al_2O$ passes up the charge column it reacts with CO formed by reaction 1, 2, and 3 to form $Al_4O_4C$ by reaction 5.

Finally, as the $Al_4O_4C$, $Al_4C_3$, and $Al_2OC$ are carried down to the reaction zone, reaction 6 proceeds and reaction 7 reverses to produce aluminum liquid, which flows to the hearth pool over unreacted charge.

In this manner vapor reflux reactions within the charge column recover the material and energy values from the vapors given off in the primary reaction zone.

Another charge formulation which can be used involves blending alumina and aluminum carbide to have carbon and oxygen in the atomic ratio 1:4. Briquettes of this composition are mixed with sufficient coke or char to provide an overall charge composition with carbon and oxygen in the atomic ratio 1:1. This charge is used in place of $Al_4O_4C$ and C and functions in a similar manner.

Vaporization products are the same as previously described and the vapors react as heretofore described to produce aluminum and recover the material and energy values from the vapors given off in the primary reaction zone.

Under conditions of very careful control of furnace operating conditions, it is possible to practice this invention using a simple mixture of alumina and carbon with a mixture weight ratio 74% alumina to 26% carbon. The difficulties with such practice arise from the facts that (1) more CO is evolved per pound of aluminum produced where the arc strikes the charge, increasing the quantity of vaporization products to be recovered in the charge column, (2) more energy has to be delivered to the charge per pound of aluminum produced, which leads to a greater quantity of vaporization products to be recovered and greater difficulty in maintaining the dual temperature condition necessary for the production of aluminum containing 10% or less of aluminum carbide.

The charge column has a certain capacity to absorb heat from the back reactions of the vaporization products to produce aluminum and products which can be made into aluminum as they approach the arc heated reaction zone. But this capacity is not unlimited, and when vapor product production exceeds the capacity of the charge column to absorb heat to make useful products it becomes impossible to keep the heated reaction zone down below the electrode system where it belongs. Unreacted vapors break through the surface of the charge column and cause what are known as "blow holes."

Nevertheless, this invention can be practiced at reduced capacity and power levels with the charges of simple mixtures of alumina and carbon in apparatus described in relation to FIGS. 1 and 2, and such charges are considered to be within the scope of this invention.

As has heretofore been stated, if the unreacted charge, over which the aluminum product flows, and the product pool were to be maintained at a reaction temperature of 2100° C, the aluminum product would dissolve up to 20% $Al_4C_3$. Such a melt is extremely difficult to handle below 2100° C and requires expensive fluxing techniques to recover the aluminum.

In this operation, however, the molten pool and major portion of the unreacted charge over which the product flows are maintained at between 1850° C and 1950° C by virtue of the fact that the arc strikes any portion of the charge less than half the time and the heat flux to the furnace walls is high. Under these conditions, only 10% or less of $Al_4C_3$ is dissolved in the aluminum produced.

The reaction between $Al_4O_4C$ and $Al_4C_3$ or carbon to produce aluminum containing about 20% $Al_4C_3$ is known and described in U.S. Pat. No. 2,829,961. This patent also teaches that vaporization products may be captured in a bed of alumina, or carbon or aluminum carbide or mixtures thereof, which may be arranged as a furnace cover over the fusion and melt. This patent describes a furnace in which additional raw materials are charged periodically through the top of the furnace, down through the upper layer fusion of aluminum containing aluminum carbide and then into the fusion of $Al_4O_4C$ where the reaction takes place. The consequence of this arrangement is that the product pool must be at the reaction temperature of about 2100° C. Means are not described nor self-evident to keep the product pool at a temperature below 1950° C, nor to accomplish the dual temperature operation necessary to produce aluminum containing less than 10% $Al_4C_3$.

The critically essential feature of the present invention are that (1) the product pool is maintained below 1950° C (which is at least 150° C below the reaction temperature), (2) the heat is applied intermittently to the surface of the charge being reduced to aluminum (illustrated by the intermittent application of an open arc), (3) the walls of the furnace have their insulation adjusted to maintain the major portion of the charge in the reduction zone below 1850° C (especially that portion of the charge over which aluminum flows to join the product pool), and (4) the vaporization products are forced to pass through the charge burden where they react to form liquid aluminum containing less than 10% $Al_4C_3$ or compounds which form said aluminum when heated to reaction temperature (about 2100° C).

The term "open arc" is used herein as intended to mean an arc from an electrode which is not in physical contact with the charge to be reacted. The electrical power of the arc is not narrowly critical since it is not the purpose of this process to maintain substantially all of the aluminum formed in the liquid state. However, it is desired that the electrical power of the arc be such that it produces an electrical density of greater than 50 kilowatts per square inch of charge struck by the arc and more preferably, between 100 and 200 kilowatts per square inch of arc struck by the charge.

As has previously been pointed out, it is also necessary that the arc should be an intermittent arc, i.e., it should be on for a period of time and off for a period of time with respect to a given area of charge. This type of operation is referred to as an intermittent operation, and this expression refers to the fact that a particular portion of the charge stock is subjected to direct electrical heating via an open arc only from 10–50 percent of the total time. Thus, by way of a convenient example the arc can be struck to a charge for a period of time of one minute and then turned off for 2 minutes and then be restruck for another minute, etc. In a preferred embodiment of this invention it is desired that the arc be applied for a period of time ranging from 1/120 to 90 seconds, and thereafter be turned off for the appropriate period of time such that the heating only occurs from 10–50 percent of the total time.

It is to be immediately understood that the most preferred embodiment of this invention which will produce the intermittent heating does not reside in turning the arc on or off, but rather, as is illustrated in FIG. 1, it is preferred that the arc be left on continuously but moved over the surface of the charge stock by either mechanical means or by the use of a magnetic field such that the arc strikes a particular portion of the charge between 10 and 50 percent of the total time.

It is to be understood that although the invention has been described with respect to the use of a plasma torch it is also possible to carry out the process of this invention using carbon electrodes. There are many techniques which can be employed with carbon electrodes in order to obtain the intermittent type of heat above referred to. Thus, for example, a bundle of electrodes can be combined in one pack e.g., six electrodes, and each electrode separated electrically from the other. Arcs can be made to progress from one electrode to another electrode by commutation of DC current or by electrical commutation.

It is also possible to use a single carbon electrode and achieve the same type intermittency. In this embodiment a slowly rotating magnetic field transverse to the arc direction can be applied to keep the arc spot regularly migrating around the periphery of a single electrode.

It has been found to be advantageous to use an open DC arc with the adjustable electrode negative with respect to the charge. The reason for this is that the negative electrode receives less of the heat while emitting electrons than the anodic charge receives. Under the DC arc operation with the movable electrode negative, the charge receives most of the heat and the electrode remains cool enough to avoid excessive volitilization of the carbon.

It is to be understood, however, that although the invention is capable of being carried out with a carbon electrode, nevertheless, it is preferred to use a plasma torch as an electrode as is set forth in FIG. 1 since it would appear that better furnace control can be obtained.

The open arc is viewed as desirable because the surface temperature of the charge has an opportunity to decrease rapidly upon arc interruption, thus permitting the majority of the charge to remain at the required low temperature as a result of heat transfer to the colder portion of the furnace during periods of arc interruption.

It is to be understood that carbon or graphite electrodes of dimensions typical of present day arc furnaces (40 inch diameter and larger) provide intermittent arcs around the periphery of the electrode when not directly conducting to the furnace charge. The arcs migrate about the electrode in a random manner, which is not under the control of the operator, for which reason we prefer to use electrode configurations or plasma torches which permit control of where the arc strikes the charge and when.

As long as provision is made to provide an open arc from a conventional carbon or graphite electrode and avoid conduction of electricity from the electrode to the charge, such electrodes are considered to provide intermittent heating of the type required to practice this invention.

Thus, in order for the novel process of this invention to be effective, it is required that when the liquid aluminum which is produced flows over an unreacted charge, it must be at a temperature below about 1900° C and preferably at a temperature ranging from 1850°–1900° C. On the other hand, after the condensed aluminum is removed from the unreacted charge or other source of carbon then, quite obviously, it can be at any temperature since there will be no unreacted charge or source of carbon and therefore no aluminum carbide which can be dissolved by the aluminum.

As has heretofore been stated, it is possible to use an open arc in order to carry out the process of this invention and although such open arc can be produced by using conventional graphite electrodes in the manner previously described, a preferred embodiment of this invention resides in using plasma torches in order to provide the open arc.

Although the use of graphite electrodes delivers heat at an appropriate power density and provides a pressurized gas effect which tends to move the aluminum produced at the surface of the charge away from the charge, it does suffer from the disadvantage in that it introduces a small amount of carbon to the product. However, the use of graphite electrodes has a further practical operating disadvantage in that if the arc is extinguished, the only practical way to re-establish an arc of this power density is to lower the electrode until it touches and makes electrical contact with the charge. This type of action can lead to difficulties with the charge sticking to the electrode. If too much charge is stuck to the electrode, the electrical discharge properties of the electrode are altered to the detriment of the overall operation. In order to avoid such problems, careful control must be exercised over the arc struck between a carbon or graphite electrode and the charge.

The use of a plasma torch eliminates the above-mentioned difficulties which can be experienced when using conventional graphite electrodes in that, quite obviously, no carbon is added to the product and the plasma jet has the advantage that the arc can be established even though the jet nozzle is completely removed from the vicinity of the charge. Additionally, if the jet is extinguished for some reason, it can be re-established without any physical part of the jet-forming equipment being brought into contact with the charge. Still another advantage of the plasma jet is that in addition to the normal tendency of the arc column to force the produced aluminum away from the charge, the jet comprises additional gas flow (which is an essential feature of the operation of plasma jets) and this additional gas flow adds to the tendency of the arc jet to remove the product aluminum away from the site of the reaction such that it can cool rapidly and not dissolve appreciable amounts of unreacted charge.

A still greater advantage can be obtained from the use of plasma jets when additional circuits are provided wherein a second power supply is connected between the cathode element of the plasma jet and the hearth so that the arc column is drawn not from a negative electrode to the jet nozzle, but instead from the negative electrode to the hearth. In this mode of operation, very little current flows to the nozzle. Most of the current flows to the hearth. A very high heating rate is established at the site of the reaction even though the nozzle of the jet can be a substantial distance (for example, 6–12 inches) away from the charge. This provides ample opportunity for the charge to pass under the jet without being struck by the casing of the jet apparatus.

If for some reason the transfer current, that is, the current from the negative electrode of the jet to the hearth, is interrupted, then the power supply of the internal jet maintains the jet in normal plasma jet operation between the negative electrode and the positive jet nozzle. This then serves as a pilot light to re-establish the jet through the second power supply to the hearth at any time, without having to move the jet physically, relative to the hearth.

This starting and stopping of the transfer power between the negative electrode and the hearth can be so rapid as to occur as often as 60 cycles per second. In fact, one of the preferred embodiments of the plasma jet application to this invention is to use half-wave DC power (for example, 60 cycles half-wave DC) for the transfer power. In this way, for one-half cycle, the transfer occurs with the interior electrode of the plasma torch negative and the hearth positive. When the voltage of the alternating current supply reverses, rectification blocks the transfer current from the hearth back to the internal electrode of the jet.

It can be seen that with this type of half-wave transfer between the internal electrode of the jet and the hearth, the peak power delivered at the target area, mainly the site of reaction, is about four times the average power delivered to the target area. The rate of heating by the plasma jet to the charge is insignificant when the arc is not transferred to the charge compared to when the arc is transferred. Therefore, on the half-cycle where the arc is not transferred to the charge, the charge can be losing heat to the relatively cool (for example, 1600° C) walls of the furnace. It can be readily understood, therefore, that the very high temperature required for the reaction only occurs in the very thin layer where the jet is striking the charge and down into the charge body and in the surrounding portions of the charge the temperature is much lower. The high temperature zone is only a small fraction of an inch thick when using half-wave DC jet transfer.

No practical way has been devised as yet to make a simple carbon electrode perform on half-wave DC transfer. Once the arc is extinguished due to the return of the voltage to to zero it must be relighted by some method which is not convenient with a carbon or graphite electrode.

Additional details of plasma torch operation are disclosed in copending application Ser. No. 407,271 filed Oct. 17, 1973, the disclosure of which is incorporated by reference.

Quite obviously, after the aluminum is tapped from the furnace, it can be subjected to purification techniques to remove the aluminum carbide.

The following examples will illustrate the process of this invention.

EXAMPLE 1

Alumina and coke or char are ground to pass 20% through a 325 mesh and all through a 20 mesh screen and blended to provide a mixture having 85 wt.% $Al_2O_3$ and 15% C. This mixture is mixed with, for example, polyvinyl alcohol binder and formed into briquettes having a maximum dimension of 2 inches. The briquettes are heated in a shaft furnace at 1950° C to convert at least half the alumina to $Al_4O_4C$. The briquettes are analyzed for carbon and oxygen and blended with coke or char to make a mixture having the overall weight proportions 12 C to 16 oxygen.

A furnace as described above and illustrated by FIG. 1 is started by first heating the hearth by impingement of the plasma jet transferred to the hearth until the hearth achieves a temperature of about 1000° C. The magnetic circuit is turned on to rotate the arc at about 1 revolution per minute and to deflect it to describe a circle of pre-determined diameter corresponding to the expected intersection of the charge with the molten pool. The plasma jet operates on an internal voltage from the full wave rectifier of about 50 volts and a half wave peak transfer voltage from negative electrode to hearth of about 250 volts. Carbon chunks 2 inches – 4 inches in dimension are placed on the hearth to a depth of 12 inches and molten aluminum is poured into the furnace to a depth of 16 inches. The heating by the plasma jet is resumed until the molten pool achieves a temperature of 1850° C.

Charge is then added to fill the furnace to its normal operating level. The plasma arc is caused to rotate at 1 revolution per second and at the previously established deflection by the control circuits of the magnet. Charge is gently poked down periodically by conventional mechanical means (not shown) within the furnace and new charge is added as necessary to maintain the level in the charge column. Air is excluded from the furnace by exhaust control keeping pressure in the range 1 – 5 atmosphere. Torch power is controlled to maintain the molten pool over the hearth in the range 1850°–1950° C. Aluminum containing 10% or less $Al_4C_3$ is periodically tapped from port 12.

EXAMPLE II

Alumina and aluminum carbide are ground to pass 20% through a 325 mesh and all through a 20 mesh screen and blended to provide a mixture having 75.5 wt.% $Al_2O_3$ and 24.5wt. % $Al_4C_3$. The mixture is further blended with 2.5% starch and cold pressed to form briquettes having a maximum dimension of 2 inches. The briquettes are blended with coke or char to make a mixture having the overall weight proportions 12 C to 16 oxygen.

A furnace as described above and illustrated in FIG. 2 is started by adding coke 1 inch and down to a depth of 12 inches directly under the electrode and surrounding this with coke to 2 inches – 4 inches in dimension to a depth of 12 inches out to the walls of the furnace. An arc is drawn from the carbon electrode to this coke on a schedule typical of the startup of conventional furnaces for the production of silicon until the hearth under the electrode has achieved a temperature of 1000° C. Molten aluminum is then poured into the furnace to a depth of 16 inches. The arc is re-established to resume heating. Sufficient charge is added (depth of 6 inches) to confine the heat of the arc until the molten pool has reached a temperature of 1850° C. Charge is thereafter added until the charge column has reached its normal operating level. Power is controlled to maintain the molten pool temperature in the range 1850° C to 1950° C. Charge is gently poked down periodically by conventional mechanical means (not shown) within the furnace and new charge is added as necessary to maintain the level of the charge column. Air is excluded from the furnace by exhaust control keeping pressure in the range 1–5 atmosphere. Aluminum containing 10% or less $Al_4C_3$ is periodically tapped from port 12.

What is claimed is:

1. A carbothermic process for the production of aluminum from an aluminum oxide which comprises A. striking an open electrical arc to a portion of the surface of a charge comprising an aluminum oxide and at least one material selected from the group consisting of carbon, aluminum compounds containing carbon, and mixtures thereof so as to form liquid aluminum and volatile products, with the proviso that only a small portion of the charge in the reaction zone is heated to reaction temperature while the majority of the charge in the reaction zone and the majority of the aluminum metal product is below reaction temperature at any given time;

B. causing said volatile products which are produced to pass through the charge and to further react and form liquid aluminum or compounds capable of forming said liquid aluminum at reaction temperature, and;

C. causing the liquid aluminum formed under the reaction conditions to flow away from the arc and over the non-reacted portions of the charge to be collected, said liquid aluminum containing no more than about 10 weight percent of aluminum carbide.

2. A carbothermic process for the production of aluminum for aluminum oxide which comprises A. reacting alumina and carbon in a proportion of about two moles of alumina to three moles of carbon at a temperature of about 1900°–1950° C to form $Al_4O_4C$;

B. charging the product of Step A together with sufficient carbon to provide a mole ratio of oxygen to carbon of about 1:1 to a reduction furnace in such a manner that the charge rests upon a hearth and in contact with a liquid pool of aluminum maintained at a temperature of about 1850°–1950° C.;

C. striking an open electrical arc to a portion of the surface of the charge comprising said $Al_4O_4C$ and carbon so as to form liquid aluminum and volatile products with the proviso that only a small portion of the charge in the reaction zone is heated to reaction temperature while the majority of the charge in the reaction zone is not at reaction temperature at any given time;

D. causing said volatile products which are produced via the reaction of Step C to pass through the charge and to further react so as to form liquid aluminum or compounds capable of forming said liquid aluminum at reaction temperature and;

E. causing the liquid aluminum formed under the reaction conditions to flow away from the arc and over the non-reacted portions of the charge and be collected, said liquid aluminum containing no more than about 10 weight percent of aluminum carbide.

3. The process of claim 2 wherein said open electrical arc is provided by a plasma torch.

4. The process of claim 3 wherein the majority of said pool is maintained at a temperature between 1850° C and 1950° C.

* * * * *